United States Patent [19]

Rogers, Jr.

[11] Patent Number: 4,694,515

[45] Date of Patent: Sep. 22, 1987

[54] SELF-INFLATABLE AIR MATTRESS IN A FOLDABLE SUPPORT

[75] Inventor: Walter C. Rogers, Jr., Denton, N.C.

[73] Assignee: Parma Corporation, Denton, N.C.

[21] Appl. No.: 878,587

[22] Filed: Jun. 26, 1986

Related U.S. Application Data

[63] Continuation-in-part of Ser. No. 678,965, Dec. 6, 1984, abandoned.

[51] Int. Cl.[4] ..... A47C 27/08

[52] U.S. Cl. ..... 5/13; 5/449; 5/450; 137/223

[58] Field of Search ..... 5/448, 449, 450, 12 R, 5/13, 441, 454, 453; 137/233, 223; 441/40, 41, 42, 90, 96, 99; 251/310

[56] References Cited

U.S. PATENT DOCUMENTS

| | | | |
|---|---|---|---|
| 2,072,570 | 3/1937 | Smith | 5/450 |
| 2,350,711 | 6/1944 | Amos | 5/449 |
| 2,779,034 | 1/1957 | Arpin | 5/450 |
| 2,843,181 | 7/1958 | Paschen | 5/441 |
| 3,017,642 | 1/1962 | Rosenberg et al. | 5/450 |
| 3,792,501 | 2/1974 | Kery | 5/12 R |
| 3,798,686 | 3/1974 | Gaiser | 5/348 |
| 3,864,766 | 2/1975 | Prete, Jr. | 5/450 |
| 3,872,525 | 3/1975 | Lea et al. | 5/450 |
| 4,064,305 | 1/1977 | Rubin | 5/13 |
| 4,153,958 | 5/1979 | Paulik | 5/453 |
| 4,169,295 | 10/1979 | Darling | 5/453 |
| 4,435,864 | 3/1984 | Callaway | 5/453 |
| 4,442,556 | 4/1984 | Craigite | 5/12 R |
| 4,594,743 | 6/1986 | Owen et al. | 5/454 |

FOREIGN PATENT DOCUMENTS

| | | | |
|---|---|---|---|
| 428124 | 7/1967 | Switzerland | 5/450 |
| 361887 | 11/1931 | United Kingdom | 5/454 |
| 984604 | 2/1965 | United Kingdom | 5/450 |

*Primary Examiner*—Cornelius J. Husar
*Assistant Examiner*—Eric K. Nicholson
*Attorney, Agent, or Firm*—William E. Mouzavires

[57] ABSTRACT

An air mattress comprising an inflatable and deflatable flexible body enclosing an air chamber having a resilient means urging the opposite upper and lower walls of the body apart while being yieldable to permit the body to be folded and deflated. In one embodiment, removable a closure is attached to the body to be received in a portal in the wall of the body to seal the chamber closed. When the body is unfolded into a generally horizontal or planar position with the portal opened, the resilient means within the body will separate the upper and lower walls of the body drawing air from the atmosphere into the chamber, the portal may then be closed to seal the air in the chamber. The air mattress is illustrated on a foldable bed including frame portions which are foldable into overlying positions to fold and deflate the mattress and which are unfoldable into a horizontal position to unfold and inflate the mattress. In a preferred embodiment, a valve in the portal is actuated to open position to deflate the mattress upon folding of the bed frame and to closed position upon unfolding of the bed frame. A linkage interconnects the valve and the bed frame to actuate the valve in response to folding or unfolding of the bed frame.

12 Claims, 15 Drawing Figures

FIG. 4
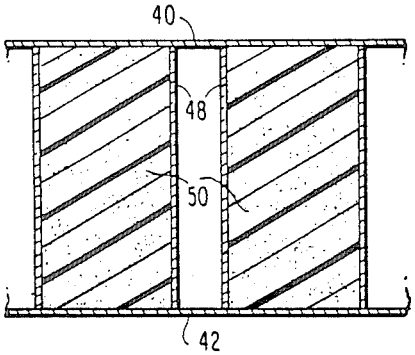
FIG. 5
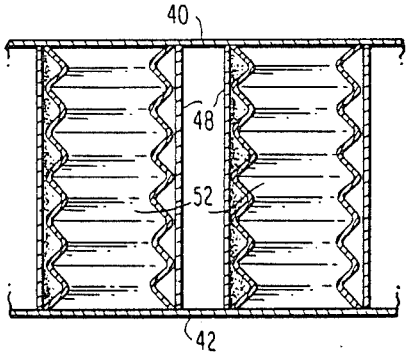
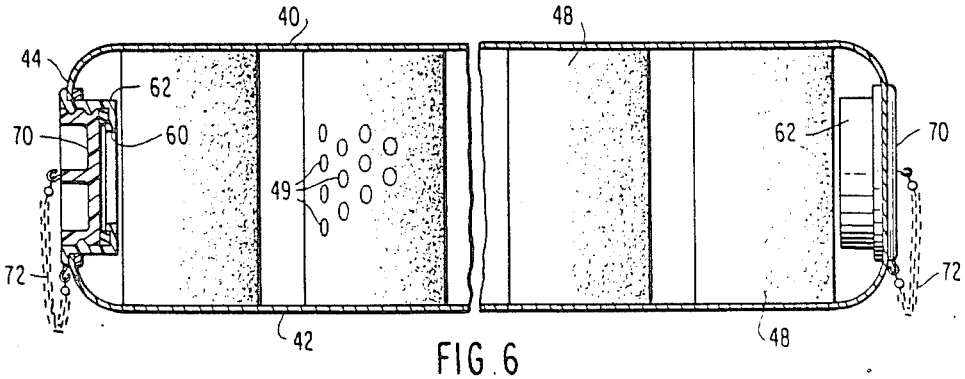
FIG. 6
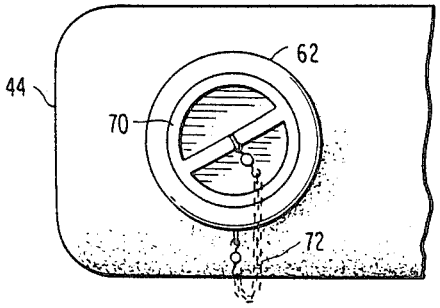
FIG. 7

SELF-INFLATABLE AIR MATTRESS IN A FOLDABLE SUPPORT

RELATED APPLICATION

This application is a continuation-in-part of U.S. application Ser. No. 678,965, filed Dec. 6, 1984, and entitled "Self-Inflatable Air Mattress" now abandoned.

BACKGROUND OF INVENTION

Air mattresses in common use today include a flexible body enclosing an air chamber which may be inflated by a pump or the like into a generally planar structure capable of supporting the human body. After inflation, the air chamber is closed by a valve member or closure received in a portal through the body. To deflate the mattress, the portal is opened and the mattress may be collapsed and folded into a storage position which substantially deflates the mattress. Various types of these mattresses are shown in U.S. Pat. Nos. 2,072,570, 2,350,711, 2,779,034, 3,017,642, 3,798,686, 3,872,525 and 3,864,766.

OBJECTS OF THE INVENTION

An object of the present invention is to provide a novel air mattress that is self-inflatable requiring no pumps or other devices to inflate it. Included herein is such an air mattress that is capable of comfortably supporting the human body.

A further object of the present invention is to provide an air mattress that may be quickly and easily inflated for use or deflated for storage.

A further object of the present invention is to provide a foldable bed or seat structure incorporating an air mattress. Included herein is such a foldable bed or seat structure which, upon folding into the seat mode, will automatically fold and deflate the air mattress and upon unfolding into the bed mode, will automatically unfold and inflate the air mattress for use.

Another object of the present invention is to provide an air mattress that may be used with conventional sofa bed or seat bed structures to increase sleeping comfort while, at the same time, allowing the sofa bed frame to be designed with modern-day low seating styles.

SUMMARY OF INVENTION

In summary, the present invention incorporates resilient means within an air mattress to separate the upper and lower walls of the mattress when placed into a horizontal or spread position to draw air into the mattress through a portal in the wall of the mattress. The portal is then closed to seal the air in the mattress. To deflate the mattress, the portal is opened and the mattress may be folded into a storage position.

In another aspect, the present invention resides in the use of the air mattress in a foldable bed or seat structure wherein folding of the structure serves to fold and deflate the mattress and unfolding of the structure serves to inflate the mattress. In one preferred embodiment, the mattress is fitted with one or more valves actuated through drive means interconnected between the valve and the structure. The valve is thus automatically opened to inflate or deflate the mattress or closed to contain the air in the mattress when inflated for use.

DRAWINGS

Other objects and advantages of the present invention will become apparent from the following more detailed description taken in conjunction with the attached drawings in which:

FIGS. 4 and 5 are fragmental views of different embodiments of the air mattress;

FIG. 6 is an end view of the air mattress when inflated with mid-portions removed and with other portions shown in cross section; and FIG. 7 is a fragmental side view of the air mattress illustrating a closure utilized to close the air chamber of the mattress after inflation;

DETAILED DESCRIPTION

Figure 1A:
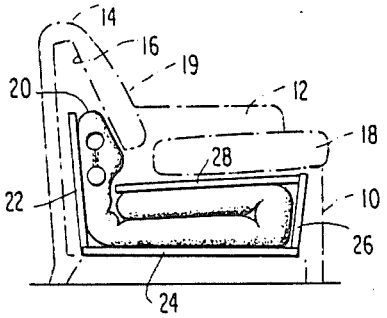
FIG. 1A is an end elevational view of a sofa bed incorporating an air mattress in accordance with the present invention and shown in the sofa mode and with portions removed to show the internal structure.

Referring now to the drawings in detail and initially to FIGS. 1A, B and C, there is shown for illustrative purposes only, a sofa bed or seat bed incorporating an air mattress in accordance with the present invention. The sofa bed may have a conventional frame generally designated 10 and including opposite armrests 12 (one shown), a backrest 14 including a cavity 16 for receiving a foldable frame and an air mattrerss 20 constructed in accordance with the present invention. The seat and backrest cushions are shown at 18 and 19 respectively. Seat cushion 18 is, of course, removable in order to permit the sofa bed to be moved between the sofa and bed modes.

Figure 1B:
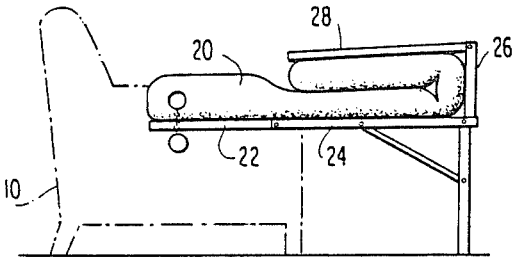
FIG. 1B is a view generally similar to FIG. 1A but with the structure shown in a position intermediate the fully unfolded and folded positions.
Figure 1C:
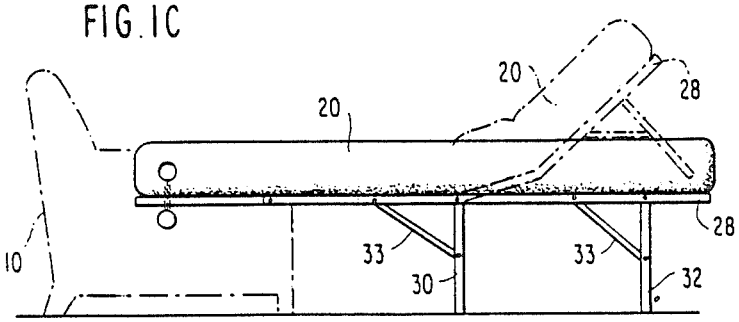
FIG. 1C is a view generally similar to FIG. 1B but with the structure shown in the fully unfolded or bed position and with portions in dotted lines showing an intermediate position.

In the specific embodiment shown, the foldable frame includes foldable rectangular portions 22, 24, 26 and 28 pivotally interconnected in series to define a horizontal mattress support structure when in the unfolded position shown in FIG. 1C. The frame also includes foldable legs 30 and 32 pivotally mounted to the frame for movement between extended unfolded positions shown in FIG. 1C for supporting the frame on the ground surface, and folded, retracted positions (not shown) when the frame is unfolded into the position shown in FIG. 1A. Inasmuch as the sofa bed frame is conventional and well-known, further description thereof is not believed to be necessary.

Figure 2:
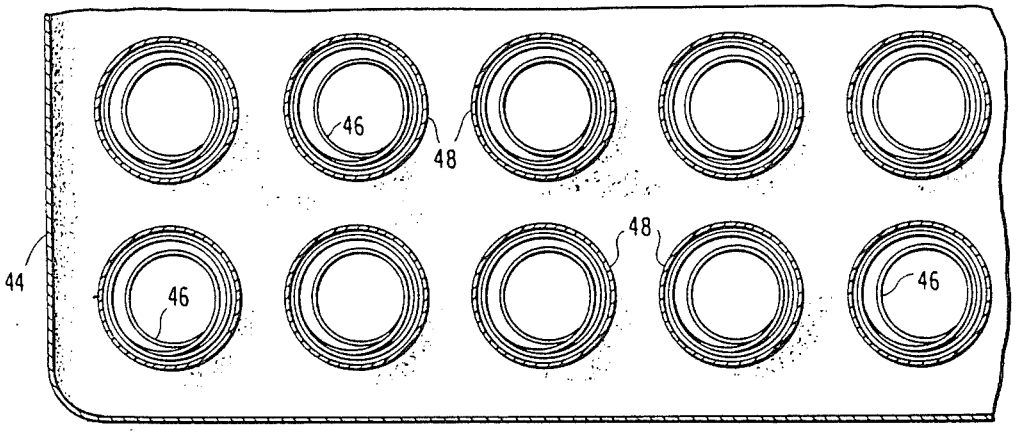
FIG. 2 is a plan view of a portion of the air mattress with portions removed to show internal springs.
Figure 3:
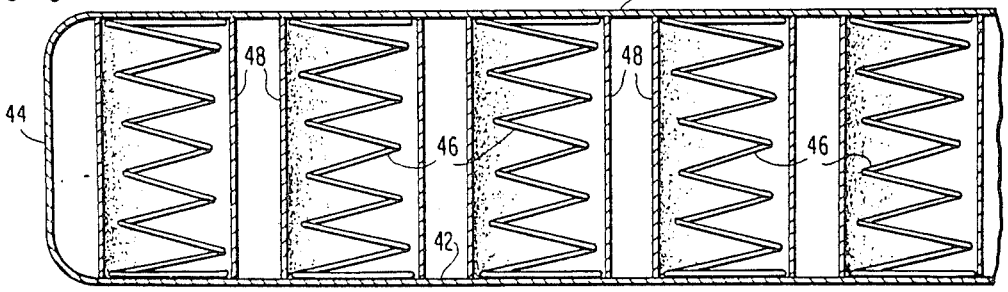
FIG. 3 is an elevational side view of the air mattress when inflated and with portions removed and other portions shown in cross section.

Referring now to FIGS. 2 and 3, air mattress 20 includes an inflatable and deflatable flexible body made of any suitable sheet-like material enclosing an air chamber and including opposite upper and lower walls 40 and 42 joined together by side walls 44 so that, when inflated, the body assumes a generally rectangular outline in plan view. In the specific embodiment shown, the size and shape of the mattress is selected to conform to that of the sofa bed frame.

In accordance with the present invention, flexible and resilient means are provided in the air chamber within the body in order to urge the upper and lower walls 40 and 42 apart into the position shown in FIG. 3 when the body is released or unfolded. In the embodiment of FIGS. 2 and 3, the resilient means is formed by a plurality of coil springs 46 extending between the upper and lower walls 40 and 42 at spaced locations throughout the length and width of the body. Although, in the specific embodiment, the springs 46 are provided in spaced rows with the springs 46 uniformly spaced from each other in each of the rows, other arrangements may be employed. The strength, number and distribution of the springs 46 is selected to achieve the stated purpose of separating the upper and lower walls 40, 42 of the mattress body into predetermined spaced apart position with the upper and lower walls 40, 42 extending in parallel planes and with the side walls 44 extending in vertical planes. In order to position the springs 46 at desired fixed locations within the mattress body, any suitable means may be employed such as the cylindrical partitions 48 shown. Partitions 48 are made from any suitable flexible sheet material whose opposite ends are respectively attached to the upper and lower walls 40, 42 of the mattress body so as to surround the springs 46 respectively and hold them in place. The partitions 46 are spaced from each other and the side walls 44 of the body so that a continuous uninterrupted air chamber is formed in the mattress body. Additionally, the partitions 48 are apertured to allow air to enter into or exit from the spaces enclosed by the partitions 48.

Instead of employing coil springs 46, other flexible and resilient means may be employed as illustrated, for example, in FIGS. 4 and 5. FIG. 4 illustrates a low-density foam plastic or other similar material 50 which is configured to occupy each of the spaces enclosed by the partitions 48. FIG. 5 illustrates a plurality of flexible bellows-like tubular structures 52 which may also be alternatively employed.

Figure 8:
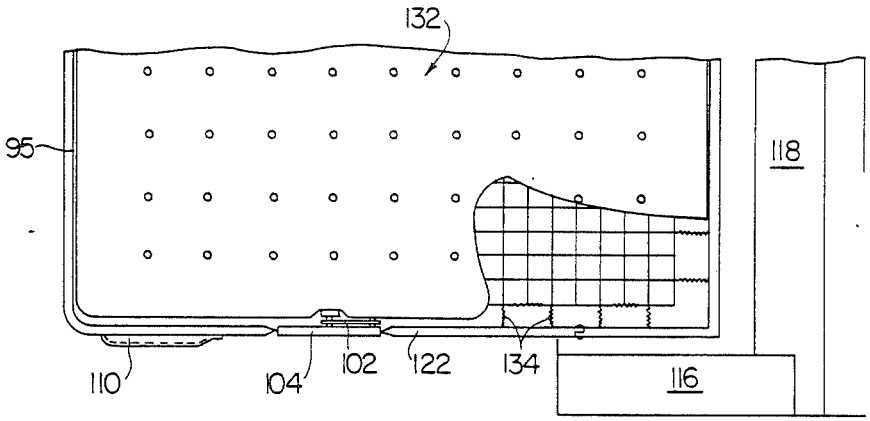
FIG. 8 is a fragmental plan view of a sofa bed in unfolded or use position and incorporating a preferred embodiment of the present invention.

In order to inflate and deflate the mattress body, one or more portals are provided through the walls of the body. In the specific embodiment shown, a tubular fitting 62 defining a portal 60 is fixed in the side wall 44 of the body as shown in FIGS. 6 and 7. Any suitable means is employed to close or open the portal. For example, as shown, a generally cylindrical closure plug 70 may be utilized having external threads engageable in complementary threads found in the fitting 62 to close the portal 60 as shown in FIG. 8. It is preferred that the fitting 62 be recessed within the mattress body with the outer surface of the fitting substantially flush with the side wall 44 of the body so that the plug 70 is receivable in the fitting 62 with the outer surface of the plug substantially flush with the side wall 44. The plug 70 is attached to the body by a chain 72 whose opposite ends are fixed to the plug and the fitting 62 so that the plugs are always conveniently available. Although in the shown embodiment, two portals each including a fitting and plug arrangement are employed in opposite side walls 44 of the body at the head end thereof, one or more than two portals may also be employed at different locations in the body.

In order to inflate the mattress for use, portals 60 are opened by removing the plugs 70. Assuming the mattress has been unfolded and released, the springs 48 will urge the upper wall 40 away from the lower wall 42 into the position shown in FIG. 3. This, of course, will also allow air to be drawn from the atmosphere into the mattress body throughout all regions therein. The plugs 70 are then inserted in the fittings 62 to close the portals 60 and seal the air within the mattress chamber. The air sealed within the chamber will thus become effective to provide air cushion support to the user.

In order to deflate the mattress, the plugs 70 are, of course, removed from the portals after which the mattress may be folded on itself which will be permitted by the escape of air from the body through the portals 60. The strength of the coil springs 48 is chosen to permit the mattress to be folded against the biasing force of the springs during which time the springs 48 will, of course, be compressed to a certain degree.

The air mattress is admirably suited for use in a sofa bed or seat bed to provide comfortable body support while, at the same time, being capable of folding into a limited space provided in the frame. FIG. 1C shows the mattress in the unfolded sofa bed frame. Although, not shown, it is preferred that the lower wall 42 of the mattress be attached to the frame portions of the sofa bed. To convert the sofa bed into the sofa mode, portals 60 are opened and then the frame portions are folded in conventional manner by first folding frame portions 28 to overlie frame portion 24 as shown in FIG. 1B. This, of corse, will serve to compress the springs 46 in the foot end of the mattress and deflate the mattress from the condition shown in FIG. 1C to the condition shown in FIG. 1B. The frame portions are then swung and folded in conventional mannner into the fully folded position shown in FIG. 1A with the head-end of the mattress received in the bottom of the cavity 16 in the backrest of the frame. During the latter folding, deflation of the mattress will continue while the springs 46 towards the head-end of the mattress will be compressed. The seat cushions 18 may then be returned on the folded frame.

In order to convert the sofa bed to the bed mode, the seat cushions 18 are, of course, first removed and then the frame portions are unfolded to the position shown in FIG. 1B and then into the fully unfolded position of FIG. 1C. This will, of course, remove pressure from the springs 46 which will then become effective to raise the upper wall 40 of the mattress into the position shown in FIG. 3, whereupon air will be admitted through the portals 60 to occupy the increased space provided between the upper and lower walls 40, 42 of the mattress by the action of the springs 46. The plugs 70 are then inserted in the portals to seal the air in the mattress for the necessary air support.

Figure 9:
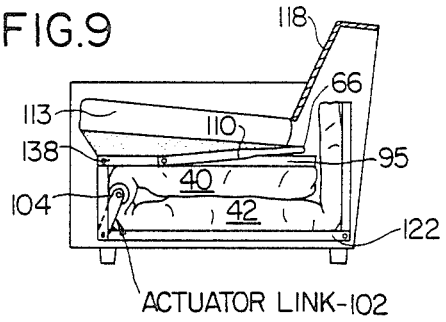
FIG. 9 is a side elevational view of the sofa bed shown in FIG. 8 but with parts removed to show the internal parts.

Reference is now made to FIGS. 8 through 13 showing a preferred embodiment of the present invention as incorporated in a sofa bed shown in FIG. 8 in the open or unfolded position for use. In the specific embodiment, and with reference to FIGS. 8 and 9, the sofa bed includes a stationary frame including a backrest 118 extending between opposite sides or armrests 116. Mounted to the stationary frame is a foldable sofa bed frame which may comprise any conventional folding frame or any other type of folding frame, it being understood the one disclosed is for illustration purposes only. In the specific embodiment, the folding frame includes a foot section 95, an intermediate section 122 and another intermediate section 104 pivotally interconnecting the foot section 95 and the section 122 for movement between the unfolded position for use as shown in FIG. 8 and the folded position for conversion into a sofa bed as shown in FIG. 9. Note that in the unfolded position shown in FIG. 8, the intermediate section 104 extends in a horizontal plane and in the folded position shown in FIG. 9 extends in a generally vertical plane displaced approximately 90 degrees from the position shown in FIG. 8. The foldable frame may include a typical spring layer shown in FIG. 8 as being connected to the frame by coil springs 134. Mounted on the spring layer is a mattress generally designated 132 constructed in accordance with the present invention. Mattress 132 is foldable from the unfolded and generally planar or horizontal positions shown in FIG. 8 to the folded position shown in FIG. 9 wherein it is folded into overlying portions 140 and 142. In the unfolded position shown in FIG. 8, a foldable leg 110 is extended to support the foot end of the frame on the ground surface and as is conventional, the leg 110 may be gripped at 166 to unfold the frame. In the sofa mode shown in FIG. 9, a seat cushion 113 is placed over the folded mattress.

Figure 10:
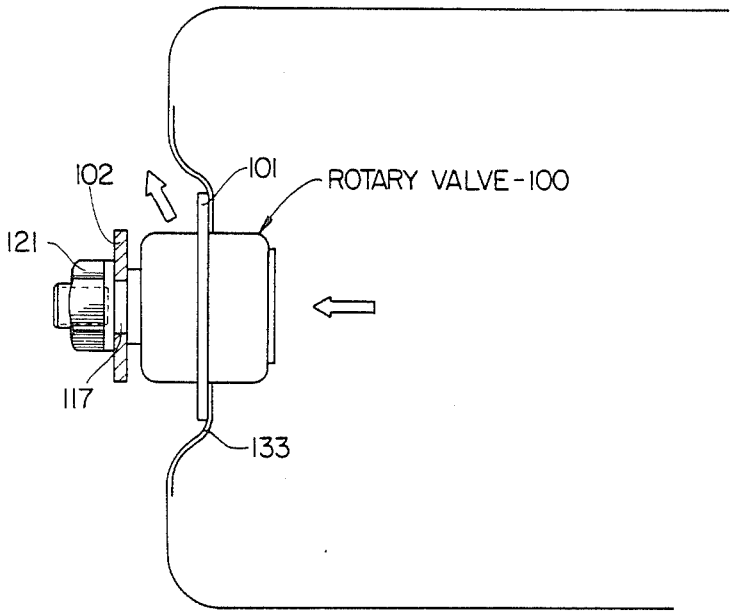
FIG. 10 is a fragmental cross-sectional view taken through the side wall of the air mattress and showing a valve included in the mattress.
Figure 11:
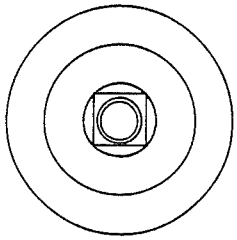
FIG. 11 is an end view of the aforementioned valve.
Figure 12:
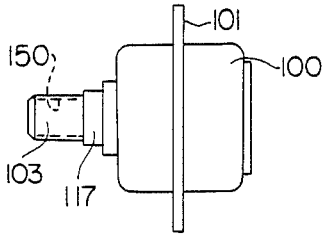
FIG. 12 is a side view of the valve.
Figure 13:
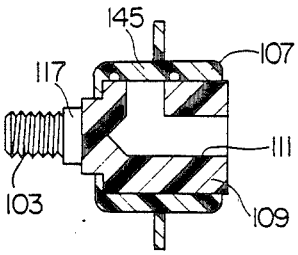
FIG. 13 is a view generally similar to FIG. 12 but taken in cross section and showing the internal rotor of the valve including the air passage in the rotor.

In accordance with the present invention, one or more valves are incorporated into the wall of the mattress to admit air into the mattress for inflating the mattress when the bed frame is unfolded and to expel air from the mattress to deflate the mattress when the bed frame is folded. In the preferred embodiment, the valve is a rotary valve generally designated 100 having a generally cylindrical casing 107 including a circular flange 101 which is heat-sealed onto the side wall of the mattress as shown in FIG. 10; it being understood that the valve casing is made from a suitable plastic material. The valve thus extends through the side wall 133 of the mattress as shown in FIG. 10. Valve 100 further includes an internal rotary plug or rotor 109 rotatable within the casing about a horizontal axis shown in FIG. 13. For communicating the interior of the mattress through air passage 111 to an exhaust or outlet port 145 in the valve casing for the purpose of either introducing air from the atmosphere or otherwise into the mattress or for expelling air or any other gas from the mattress through the outlet port 145 to atmosphere. In another position obtained by rotating the plug 109 from the position shown in FIG. 13, the air passage 111 will be blocked from communication with the outlet port 145 to thus seal the interior of the air mattress to the atmosphere to contain the air or other gas within the mattress when it is inflated for use.

The valve plug 109 is rotated through a stem 103 axially projecting from the plug 109 and including, on its outer end, threads 150 for receiving a nut 121 shown in FIG. 10 which contains an actuating or a drive link 102. The latter is employed to transfer motion from the bed frame to the valve stem for actuating the valve in response to folding or unfolding of the bed frame so as to achieve automatic inflation and deflation of the mattress in response to folding or unfolding of the mattress and the bed frame. The drive link 102 has, on one end, a square or polysided aperture which fits and receives a square land or shoulder 117 formed on the valve stem inwardly of the threaded portion. Lock nut 121 thus serves to maintain the drive link 102 properly positioned on the square land 117 of the valve stem so that upon rotation of the drive link 102, the valve will be actuated between open or closed positions.

The drive link 102 is rotated by being connected at the end opposite the valve to the intermediate link 104 of the bed frame to be rotatable therewith when the bed frame moves between the unfolded position shown in FIG. 8 and the folded position shown in FIG. 9. The square land 117 on the valve stem is calibrated relative to the air passage 111 and the outlet port 145 such that when the bed frame is moved to the unfolded position shown in FIG. 8 for use, the valve stem will be rotated by the drive link 102 a sufficient amount to close the air passage 111 to the atmosphere and when the bed frame is moved towards the folded position shown in FIG. 9, the air passage 111 will be immediately placed into registry with the exhaust port 145 in the casing to immediately begin to vent the air or gas from within the air mattress to atmosphere through the outlet port 145. Although only one valve 100 is shown in FIG. 8, it will be understood that another valve will be fitted in the air mattress on the side opposite the valve 102 shown in FIG. 8. In addition, additional valves similar to valve 100 may be employed at additional locations spaced along the side walls of the air mattress to be actuated by a drive link connected between the valve stem and the foldable bed frame such as at frame portions 95 or 110. Moreover, other types of valves and valve locations will be envisioned without departing from the scope of the present invention.

It will be understood that the remainder of the air mattress 132 may be formed in accordance with one or more of the embodiments disclosed in FIGS. 1A through 7 of the drawings and described above. In use, and assuming the bed is in folded position with the mattress also folded and deflated, the valves 100 will be in open position communicating the interior of the mattress with atmosphere. When the bed is unfolded to convert it for use as a bed, the resilient means within the mattress will separate the upper and lower walls of the mattress and air will be sucked into the mattress from atmosphere through the valve to inflate the mattress. When the bed is fully unfolded into the horizontal position, valves 100 will be closed to contain the air in the mattress to thereby keep the mattress inflated for use.

Although the air mattress has been shown and described in conjunction with a sofa bed, it will be readily apparent that the air mattress may be used alone on any support surface, that is, without a sofa bed or other convertible structure.

What is claimed is:

1. An air mattress comprising in combination a foldable body including opposite upper and lower walls and side walls defining an air chamber, resilient means in said chamber urging said upper and lower walls apart from each other while being yieldable to permit said upper and lower walls to be moved relative to each other to deflate the body, valve means on the body to admit air into and to expel air from said chamber, and actuating means connected to said valve means for closing and opening said valve means in response to unfolding and folding of the body, and wherein said valve means is located in at least one of the walls of the mattress and said actuating means includes means connected to a foldable frame for actuating the valve in response to folding movement of the frame.

2. The air mattress defined in claim 1 wherein said valve means includes a rotary plug valve including a rotor having an air passage which, in one position of the rotor, communicates the air chamber with atmosphere and in another position of the rotor, seals off the air chamber of the mattress from atmosphere.

3. A foldable body support structure comprising in combination a frame including foldable portions movable between an unfolded position defining a generally horizontal mattress support and a folded position wherein one of said frame portions generally overlies another frame portion, an air mattress on said frame including a body with opposed upper and lower walls defining an air chamber, said body being movable between a generally horizontal unfolded position when the frame portions are in said unfolded position and a folded position when said frame portions are in said folded position, valve means for admitting air into said air chamber when said body is is moved from said folded position to said unfolded position and for closing said chamber when said body is in said unfolded position, and drive means connected to a foldable portion of said frame for actuating said valve means between open and closed positions in response to movement of said foldable portions between said folded and unfolded positions.

4. The foldable structure defined in claim 3 wherein said drive means is connected to said valve means.

5. The foldable structure defined in claim 3 further including resilient means within said chamber urging the upper and lower walls away from each other to inflate the air mattress.

6. The foldable structure defined in claim 3 wherein said air mattress body includes a side wall between the upper and lower walls and wherein said valve means is located in said side wall.

7. The foldable structure defined in claim 6 wherein said valve means includes a rotary plug valve including a rotor having an air passage communicating at one end with the air chamber, an outlet port communicating with atmosphere and wherein said rotor is movable between a first position wherein the air passage communicates with atmosphere through the outlet port and a second position wherein the air passage is sealed off from the atmosphere.

8. The foldable structure defined in claim 7 wherein said valve means has a valve stem fixed to the rotor and located externally of the mattress and wherein said drive means is connected to the valve stem to rotate the valve stem upon rotation of the drive means.

9. The foldable structure defined in claim 8 wherein said drive means includes a link having a polysided aperture and wherein said valve stem has a polysided land portion received in said polysided aperture of the link.

10. The foldable structure defined in claim 3 wherein said valve means includes a rotary plug valve including a rotor having an air passage communicating at one end with the interior of the mattress, an outlet port communicating with atmosphere and wherein said rotor is movable between a first position wherein the air passage communicates with atmosphere through the outlet port and a second position wherein the air passage is sealed off from the atmosphere.

11. The foldable structure defined in claim 10 further including resilient means within said chamber urging the upper and lower walls away from each other to inflate the air mattress.

12. The foldable structure defined in claim 11 wherein said drive means is connected to said valve means.

* * * * *